US008475647B2

(12) United States Patent
Cherrillo et al.

(10) Patent No.: US 8,475,647 B2
(45) Date of Patent: Jul. 2, 2013

(54) DIESEL FUEL AND A METHOD OF OPERATING A DIESEL ENGINE

(75) Inventors: Ralph Anthony Cherrillo, Houston, TX (US); Richard Hugh Clark, Chester (GB); Mary Ann Dahlstrom, Katy, TX (US); Ian Geoffrey Virrels, Chester (GB)

(73) Assignee: Shell Oil Company, Houston, TX (US)

( * ) Notice: Subject to any disclaimer, the term of this patent is extended or adjusted under 35 U.S.C. 154(b) by 422 days.

(21) Appl. No.: 11/465,642

(22) Filed: Aug. 18, 2006

(65) Prior Publication Data

US 2007/0187293 A1 Aug. 16, 2007

Related U.S. Application Data

(60) Provisional application No. 60/710,321, filed on Aug. 22, 2005.

(51) Int. Cl.
*C10L 1/08* (2006.01)

(52) U.S. Cl.
USPC ..... 208/15; 208/950; 44/300; 565/14

(58) Field of Classification Search
USPC ..... 700/266; 252/68; 208/15, 950; 44/300; 585/14
See application file for complete search history.

(56) References Cited

U.S. PATENT DOCUMENTS

| | | | | |
|---|---|---|---|---|
| 4,208,190 | A | 6/1980 | Malec | 44/53 |
| 4,686,238 | A | 8/1987 | Bode et al. | 518/700 |
| 5,037,856 | A | 8/1991 | Post et al. | 518/714 |
| 5,490,864 | A | 2/1996 | Herbstman et al. | 44/379 |
| 5,958,985 | A | 9/1999 | Geerlings et al. | 518/700 |
| 6,204,426 | B1 | 3/2001 | Miller et al. | 585/739 |
| 6,611,735 | B1 * | 8/2003 | Henly et al. | 700/266 |
| 6,759,440 | B2 | 7/2004 | Geerlings et al. | 518/715 |
| 6,806,297 | B2 | 10/2004 | Huisman et al. | 518/705 |
| 6,852,762 | B2 | 2/2005 | De Graaf et al. | 518/705 |
| 2002/0104779 | A1 | 8/2002 | Connor et al. | 208/15 |
| 2002/0193646 | A1 | 12/2002 | O'rear | 585/3 |
| 2005/0154240 | A1 | 7/2005 | Myburgh et al. | 585/14 |
| 2009/0278077 | A1 * | 11/2009 | Shah et al. | 252/68 |

FOREIGN PATENT DOCUMENTS

| | | |
|---|---|---|
| EP | 0147240 | 12/1984 |
| EP | 0482253 | 10/1990 |
| EP | 0583836 | 8/1993 |
| EP | 0613938 | 2/1994 |
| EP | 0557516 | 7/1996 |
| EP | 1101813 | 5/2001 |
| EP | 1365007 | 11/2003 |
| EP | 1398364 | 3/2004 |

(Continued)

OTHER PUBLICATIONS

SAE Technical Paper 2000-01-1912—International Spring Fuels & Lubricants Meeting & Exposition, Paris, France, Jun. 19-22, 2000.

(Continued)

*Primary Examiner* — James Goloboy
*Assistant Examiner* — Chantel Graham

(57) ABSTRACT

A diesel fuel based on a blend of a diesel fuel derived from a Fischer-Tropsch process, and a mineral oil based diesel fuel having a sulfur content of less than 100 ppmw; and a method of operating a diesel engine, which method involves combusting such diesel fuel in the diesel engine.

39 Claims, 1 Drawing Sheet

FOREIGN PATENT DOCUMENTS

| | | |
|---|---|---|
| GB | 960493 | 12/1961 |
| WO | WO9417160 | 8/1994 |
| WO | WO9533805 | 12/1995 |
| WO | WO9714768 | 4/1997 |
| WO | WO9714769 | 4/1997 |
| WO | WO9801516 | 1/1998 |
| WO | WO9842808 | 10/1998 |
| WO | WO0011116 | 3/2000 |
| WO | WO0011117 | 3/2000 |
| WO | WO0012654 | 3/2000 |
| WO | WO0020534 | 4/2000 |
| WO | WO0020535 | 4/2000 |
| WO | WO0183406 | 11/2001 |
| WO | WO0183641 | 11/2001 |
| WO | WO0183647 | 11/2001 |
| WO | WO0183648 | 11/2001 |
| WO | WO2004035713 | 4/2004 |
| WO | WO2005021689 | 3/2005 |
| WO | WO2005105961 | 11/2005 |
| WO | WO2006135731 | 12/2006 |

OTHER PUBLICATIONS

SAE Technical Paper 972898—International Fall Fuels & Lubricants Meeting & Exposition, Tulsa, Oklahoma, Oct. 13-16, 1997.

SAE Technical-Paper 982526—International Fall Fuels & Lubricants Meeting & Exposition, San Francisco, California, Oct. 19-22, 1998.

SAE Technical Paper 2000-02-2048—International Spring Fuels & Lubricants Meeting & Exposition, Paris, France, Jun. 19-22, 2000.

SAE Technical Paper 2003-01-0763—SAE World Congress, Detroit, Michigan, Mar. 3-6, 2003.

SAE Technical Paper 2001-01-3518, "Emissions from Fischer-Tropsch Diesel Fuels," Jack W. Johnson et al.

"The Lubricity of Diesel Fuels," by Danping Wei and H. A. Spikes, *Wear*, 111 (1986) pp. 217-235.

* cited by examiner

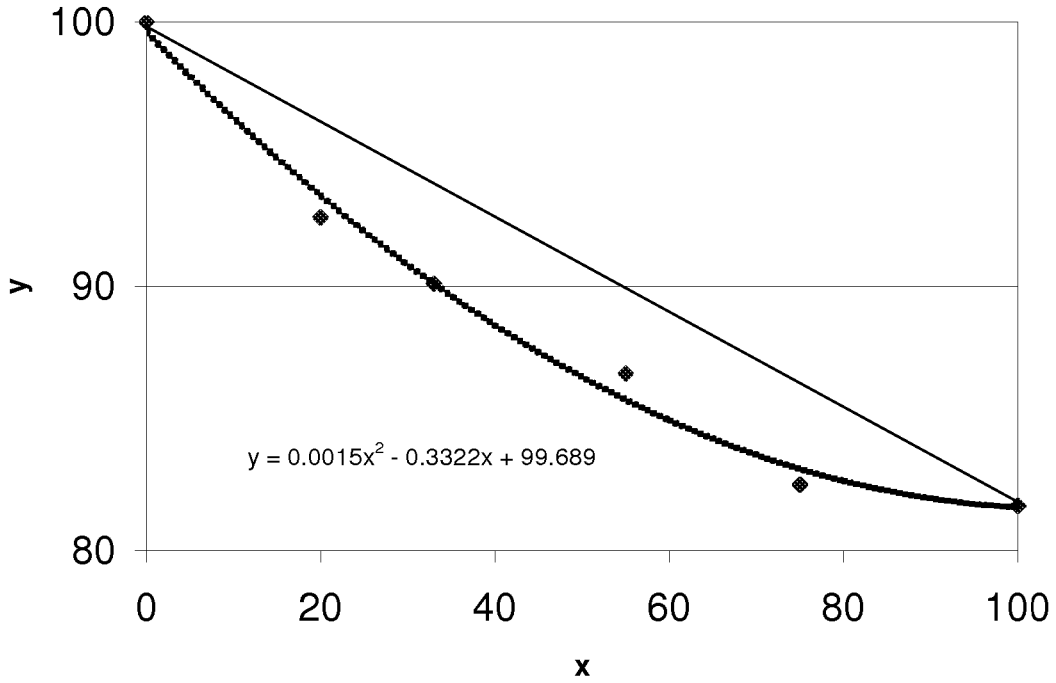
100
90
80
y
0
20
40
60
80
100
x
y = 0.0015x2 - 0.3322x + 99.689

DIESEL FUEL AND A METHOD OF OPERATING A DIESEL ENGINE

This application claims the benefit of U.S. Provisional application 60/710,321, filed Aug. 22, 2005.

FIELD OF THE INVENTION

The invention relates to a diesel fuel comprising a diesel fuel derived from a Fischer-Tropsch process, and a mineral oil based diesel fuel. The invention also relates to a method of operating a diesel engine, which method comprises combusting such diesel fuel in the diesel engine.

BACKGROUND OF THE INVENTION

Diesel engine manufacturers and diesel fuel producers are continuously challenged to meet lower emission standards set forth by the U.S. Environmental Protection Agency (EPA), as well as other such agencies worldwide. These standards for both diesel and gasoline engines mandate limits for unburned hydrocarbons, carbon monoxide and oxides of nitrogen.

The toxicity of oxides of nitrogen and their ability to further react to produce additional toxic materials make them an undesirable by-product from the burning of hydrocarbons. When released into the atmosphere, these compounds and their products comprise what is commonly referred to as "smog", a brownish haze seen over most major metropolitan areas.

The Engineering Society for Advancing Mobility Land Sea Air and Space mentioned in a paper that it appears that where a conventional diesel fuel is blended with a diesel fuel derived from a Fisher-Tropsch process, reductions in concentrations of emissions are generally reduced in a proportional fashion by adding increasing amounts of the Fischer-Tropsch fuel. In particular, emissions of oxides of nitrogen appear to follow this trend. (see SAE Technical Paper 2000-01-1912, page 6).

It would be useful to improve the methods by which reductions in emissions of oxides of nitrogen can be accomplished.

SUMMARY OF THE INVENTION

The invention provides a diesel fuel comprising a blend consisting essentially of (a) a diesel fuel derived from a Fischer-Tropsch process; and (b) a mineral oil based diesel fuel having a sulfur content of less than 100 ppmw.

The invention also provides a method of operating a diesel engine, which method comprises combusting in the diesel engine a diesel fuel comprising a blend consisting essentially of (a) a diesel fuel derived from a Fischer-Tropsch process; and (b) a mineral oil based diesel fuel having a sulfur content of less than 100 ppmw.

In an embodiment, the invention provides a diesel fuel comprising a blend consisting essentially of (a) a diesel fuel derived from a Fischer-Tropsch process; and (b) a mineral oil based diesel fuel having a sulfur content of less than 100 ppmw; wherein the weight fraction of component (a) in the blend is between 0.2 and 0.5.

In another embodiment, the invention provides a method of operating a diesel engine, which method comprises combusting in the diesel engine a diesel fuel comprising a blend consisting essentially of (a) a diesel fuel derived from a Fischer-Tropsch process; and (b) a mineral oil based diesel fuel having a sulfur content of less than 100 ppmw; wherein the weight fraction of component (a) in the blend is between 0.2 and 0.5.

In another embodiment, the invention provides a diesel fuel comprising a blend consisting essentially of (a) a diesel fuel derived from a Fischer-Tropsch process; and (b) a mineral oil based diesel fuel having a sulfur content of less than 100 ppmw and a $T_{90}$ of more than 261° C.

In another embodiment, the invention provides a method of operating a diesel engine, which method comprises combusting in the diesel engine a diesel fuel comprising a blend consisting essentially of (a) a diesel fuel derived from a Fischer-Tropsch process; and (b) a mineral oil based diesel fuel having a sulfur content of less than 100 ppmw and a $T_{90}$ of more than 261° C.

In another embodiment, the invention provides a method of operating a heavy duty diesel engine, which method comprises combusting in the diesel engine a diesel fuel comprising a blend consisting essentially of (a) a diesel fuel derived from a Fischer-Tropsch process; and (b) a mineral oil based diesel fuel having a sulfur content of less than 100 ppmw.

In another embodiment, the invention provides a method of operating a diesel engine, which method comprises combusting in the diesel engine a diesel fuel comprising a blend consisting essentially of (a) a diesel fuel derived from a Fischer-Tropsch process; and (b) a mineral oil based diesel fuel having a sulfur content of less than 100 ppmw, wherein the diesel engine produces an emission of oxides of nitrogen which is P % lower than an emission of oxides of nitrogen which can be calculated on the basis of a linear blending behavior of components (a) and (b), P is relative to the emission of oxides of nitrogen caused by the said mineral oil based diesel fuel, and P is defined by the equation $$P=A\cdot X\cdot(1-X),$$

in which equation A is a number in the range of from 10 to 25, and X is the weight fraction of component (a) in the blend, expressed as a number in the range of from 0 to 1.

In another embodiment, the invention provides a method of reducing the emission of oxides of nitrogen caused by diesel engine powered vehicles participating in traffic, which method comprises providing a diesel fuel comprising a blend consisting essentially of (a) a diesel fuel derived from a Fischer-Tropsch process; and (b) a mineral oil based diesel fuel having a sulfur content of less than 100 ppmw, wherein the weight fraction of component (a) in the blend is between 0.2 and 0.5, and combusting the diesel fuel in the diesel engines of at least 50 vehicles of the vehicles participating in said traffic.

BRIEF DESCRIPTION OF THE DRAWING

FIG. 1 shows a plot of emissions of oxides of nitrogen ("y") found when testing a Fuel A, a Fuel B, and blends of Fuels A and B, as detailed in the Examples hereinafter. "x" represents the weight fraction of Fuel B in the blends, expressed in % w. The value of the emission found for Fuel A is normalized to 100 (i.e. y=100 when x=0).

DETAILED DESCRIPTION OF THE INVENTION

When a diesel fuel comprising a blend of a mineral oil based diesel fuel having a low sulfur content and a diesel fuel derived from a Fischer-Tropsch process is combusted in a diesel engine in accordance with this invention, a significant reduction in the emission of oxides of nitrogen is accomplished.

Unexpectedly, the emission of oxides of nitrogen appears to be non-linear with the blend composition. It is advantageous that the non-linear blending behavior is such that the blends provide lower emissions of oxides of nitrogen relative to the emissions which can be calculated on the assumption of a linear blending behavior. An important aspect of this invention is that this allows for blends having a relatively low weight fraction of the Fischer-Tropsch derived diesel fuel to provide for a relatively low emission of oxides of nitrogen.

Another important aspect of this invention is the insight that, on the basis of a certain quantity of Fischer-Tropsch derived diesel fuel, a greater reduction in the cumulative emission of oxides of nitrogen caused by a large numbers of diesel engine powered vehicles participating in traffic can be achieved by combusting in the diesel engines of such vehicles the Fischer-Tropsch derived diesel fuel in the form of a blend with the mineral oil based diesel fuel, as opposed to combusting the Fischer-Tropsch derived diesel fuel separately from the mineral oil based diesel fuel. The greatest reduction in the cumulative emission can be achieved by employing a blend having a relatively low weight fraction of the Fischer-Tropsch derived diesel fuel, for example blends wherein said weight fraction is between 0.2 and 0.5.

Also, in accordance with this invention, blends of a diesel fuel derived from the Fischer-Tropsch process and the mineral oil based diesel fuel have an advantageously low value of the Ramsbotton on 10%. The value is better than may be expected when assuming a linear blending behavior for such diesel fuels with respect to the value of the Ramsbotton on 10%. This indicates that the blends have an advantageous behavior in a tendency to produce less coke.

The diesel engine may be any combustion engine suitable for combusting diesel fuel and may be operated in any suitable fashion for combusting diesel fuel. Generally, the diesel engine may be a heavy-duty diesel engine or a light duty diesel engine. As used herein, a heavy-duty diesel engine has a volume of displacement greater than 8.3 L, and a light-duty engine has a volume of displacement of 8.3 L or less. Preferably, the diesel engine is a heavy-duty engine, for example as used in construction machines, tractor-trailers and buses. However, a light-duty diesel engine, for example, as used in pickups, sport utility vehicles, Class 3 delivery trucks, vans, taxis and passenger cars, may be used as well.

For purposes of this specification, various properties are as measured as follows: density in g/mL by ASTM Method D4052, sulfur content in ppmw by ASTM Method D5453, nitrogen content in ppmw by ASTM Method D4629, boiling points and boiling point ranges (in ° C.) by ASTM Method D0086, aromatics content in % w by ASTM Method D5186, polynuclear aromatics (PNA) content in % w by ASTM Method D5186, cetane number by ASTM Method D0613, linear, iso- and cyclo-paraffins contents in % w by ASTM Method D2425, and Ramsbottom on 10% by ASTM D524. As used herein, "ppmw" means parts per million by weight, and "% w" means percent by weight. In addition, by $T_{90}$ is meant the distillation temperature at which 90% of the fuel has been evaporated.

A useful method for determining emissions of oxides of nitrogen, hydrocarbons, carbon monoxide, carbon dioxide, and particulate matter (all in g/hp-hr) is detailed in the EPA Federal Test Procedure in the Code of Federal Regulations, Title 40, Part 86, Subpart N (40 CFR §86(N)). Emission measurements on the basis of the method detailed therein, and used in the Examples hereinafter, may provide a suitable yardstick for the reduction of emissions of oxides of nitrogen which can be achieved when practicing this invention.

In the practice of this invention a diesel fuel is employed which comprises a blend consisting of a diesel fuel derived from a Fischer-Tropsch process ("component (a)") and a mineral oil based diesel fuel ("component (b)"). Component (b) has a sulfur content of less than 100 ppmw.

The weight fraction of component (a) in the blend may vary between wide ranges. Typically, the weight fraction of component (a) is more than 0.2, more typically at least 0.25, preferably at least 0.28, and more preferably at least 0.3. Typically, the weight fraction of component (a) is less than 0.5, more typically at most 0.4, and preferably at most 0.35. The component (b) represents the balance in the blend.

Component (a), the Fischer-Tropsch derived diesel fuel, may be any diesel fuel which is prepared from the product of a Fischer-Tropsch process. The diesel fuel product may be obtained by fractionation of such a Fischer-Tropsch process product or obtained from a hydroconverted (via hydrocracking/hydroisomerization) Fischer-Tropsch process product. Examples of Fischer-Tropsch derived diesel fuels are described in EP-A-583836, WO-A-9714768, WO-A-9714769, WO-A-011116, WO-A-011117, WO-A-0183406, WO-A-0183648, WO-A-0183647, WO-A-0183641, WO-A-0020535, WO-A-0020534, EP-A-1101813 and U.S. Pat. No. 6,204,426, all of which are hereby incorporated by reference. The Fischer-Tropsch process is a well known method for producing hydrocarbons, see for example, U.S. Pat. Nos. 4,686,238, 5,037,856, 5,958,985, 6,759,440 B2, 6,806,297 B2, and 6,852,762 B2, all of which are herein incorporated by reference.

Suitably, component (a), the Fischer-Tropsch derived diesel fuel, may comprise at least 90% w, more preferably at least 95% w, of iso and linear paraffins, for example up to at most 99.9% w. The weight ratio of iso-paraffins to normal paraffins may suitably be greater than 0.3. This ratio may be up to 12. Suitably this ratio is between 2 and 6. The actual value for this ratio may be determined, in part, by the hydroconversion process used to prepare the Fischer-Tropsch derived diesel fuel from the Fischer-Tropsch synthesis product. Cyclic-paraffins may be present, but this amount is typically below 5% w, and frequently at least 0.1% w. By virtue of the Fischer-Tropsch process, component (a) has essentially zero content of sulfur and nitrogen (or amounts which are no longer detectable). The content of sulfur may typically be less than 1 ppmw. The content of nitrogen may typically be less than 1 ppmw. These hetero-atom compounds are poisons for Fischer-Tropsch catalysts and are typically removed from the synthesis gas that is the feed for the Fischer-Tropsch process. Typically, the process does not make aromatics, or as usually operated, virtually no aromatics are produced. The content of aromatics may typically be below 2% w, more typically at most 1% w, preferably at most 0.5% w, and frequently at least 0.01% w. The content of polynuclear aromatics (PNA) may typically be below 1% w, preferably at most 0.5% w, and frequently at least 0.005% w.

Component (a), the Fischer-Tropsch derived diesel fuel, may suitably have a boiling range which may be from about 150° C. to 400° C. Component (a) may suitably have a $T_{90}$ of from 280° C. to 340° C. The density of component (a) may be in the range of from 0.76 g/mL to 0.79 g/mL at 15° C. The cetane number of component (a) may be at least 60, preferably at least 70, more preferably at least 74. Frequently, the cetane number of component (a) may be at most 90, more frequently at most 85, in particular at most 80. The viscosity of component (a) may be in the range of from 2.5 centistokes to 4 centistokes at 40° C.

The diesel fuel of component (b) may be prepared from any mineral oil. The mineral oil based diesel fuel of component (b) may suitably have a boiling range of from 158° C. to 355° C. The $T_{90}$ boiling point may suitably be more than 261° C., more suitably at least 265° C., preferably at least 275° C. and more preferably at least 285° C. The $T_{90}$ may preferably be at most 330° C. and more preferably at most 325° C. The aromatics content may suitably be less than 30% w, preferably at most 20% w and most preferably at most 10% w. The aromatics content may typically be at least 2% w, more typically at least 5% w. The polynuclear aromatics (PNA) content may preferably be at most 20% w, more preferably at most 15% w, most preferably at most 5% w. The polynuclear aromatics (PNA) content may typically be at least 1% w, more typically at least 1.5% w. The cetane number may suitably be at least 25, more suitably at least 35 and preferably at least 40. The cetane number may suitably be at most 55, more suitably at most 50 and preferably at most 45. The sulfur content may preferably be at most 50 ppmw, more preferably at most 10 ppmw, and most preferably at most 5 ppmw. The sulfur content may typically be at least 1 ppmw, more typically at least 1.5 ppmw. The Ramsbottom on 10% may suitably be at most 0.15, preferably at most 0.10 and more preferably at most 0.07. In the normal practice of this invention, the Ramsbottom on 10% may frequently be at least 0.01, or more frequently at least 0.02. The nitrogen content of component (b) may suitably be at most 100 ppmw, preferably at most 50 ppmw, more preferably at most 25 ppmw. The nitrogen content may frequently be at least 1 ppmw, more frequently at least 2 ppmw. The cyclic-paraffins content may be at least 5% w and typically at most 10% w.

The blend of components (a) and (b) may suitably have a boiling range of from 160° C. to 355° C. Suitably, the $T_{90}$ may be at least 310° C., preferably at least 315° C. and more preferably at least 320° C. The $T_{90}$ may suitably be at most 340° C., preferably at most 335° C. and more preferably at most 330° C. The aromatics content may suitably be less than or equal to 30% w, preferably at most 15% w and most preferably at most 10% w. In the normal practice of this invention, the aromatics content may frequently be at least 0.5% w, more frequently at least 1% w. The cetane number may typically be at least 42, preferably at least 45 and more preferably, the cetane number may be at least 50. The cetane number may typically be at most 68, more typically at most 65, preferably at most 60 and more preferably, at most 55. The sulfur content may preferably be less than 50 ppm, more preferably less than 10 ppm, and most preferably less than 5 ppm. Frequently the sulfur content is at least 0.1 ppmw, more frequently at least 0.2 ppmw. The Ramsbottom on 10% may suitably be less than 0.15, preferably less than 0.10 and more preferably less than 0.07. The nitrogen content of the blend may suitably be less than 10 ppm, preferably less than 8 ppm, more preferably less than 6 ppm. Frequently, the nitrogen content is at least 0.1 ppmw, more frequently at least 1 ppmw.

The diesel fuels may be additized (additive-containing) fuels or unadditized (additive-free) fuels. If additized, the fuels may contain minor amounts of one or more additives selected, for example, from anti-static agents, pipeline drag reducers, flow improvers (e.g. ethylene/vinyl acetate copolymers or acrylate/maleic anhydride copolymers), lubricity additives, antioxidants and wax anti-settling agents. Typically, the blend of components (a) and (b) may constitute at least 90% w of the diesel fuel of this invention, or for use in this invention. More typically, the blend of components (a) and (b) may constitute at least 95% w of the diesel fuel, or even more, such as for example 98% w or 99% w. Typically, the blend of components (a) and (b) may constitute at most 100% w of the diesel fuel, more typically at most 99.9% or at most 99.5% w.

Detergent-containing diesel fuel additives are known and commercially available. Such additives may be added to the diesel fuel at levels intended to reduce, remove, or slow the build up of engine deposits.

Examples of detergents suitable for use as an additive for the present purpose fuel include polyolefin substituted succinimides or succinamides of polyamines, for instance polyisobutylene succinimides or polyisobutylene amine succinamides, aliphatic amines, Mannich bases or amines and polyolefin (e.g. polyisobutylene) maleic anhydrides. Succinimide dispersant additives are described for example in GB-A-960493, EP-A-0147240, EP-A-0482253, EP-A-0613938, EP-A-0557516 and WO-A-98/42808. Particularly preferred are polyolefin substituted succinimides such as polyisobutylene succinimides.

The additive may contain other components in addition to the detergent. Examples are lubricity enhancers; dehazers, e.g. alkoxylated phenol formaldehyde polymers; anti-foaming agents (e.g. polyether-modified polysiloxanes); ignition improvers (cetane improvers) (e.g. 2-ethylhexyl nitrate (EHN), cyclohexyl nitrate, di-tert-butyl peroxide and those disclosed in U.S. Pat. No. 4,208,190 at column 2, line 27 to column 3, line 21); anti-rust agents (e.g. a propane-1,2-diol semi-ester of tetrapropenyl succinic acid, or polyhydric alcohol esters of a succinic acid derivative, the succinic acid derivative having on at least one of its alpha-carbon atoms an unsubstituted or substituted aliphatic hydrocarbon group containing from 20 to 500 carbon atoms, e.g. the pentaerythritol diester of polyisobutylene-substituted succinic acid); corrosion inhibitors; reodorants; anti-wear additives; anti-oxidants (e.g. phenolics such as 2,6-di-tert-butylphenol, or phenylenediamines such as N,N'-di-sec-butyl-p-phenylenediamine); metal deactivators; and combustion improvers.

It is particularly preferred that the additive include a lubricity enhancer, especially as the diesel fuel composition has a low sulfur content. In the additized fuel composition, the lubricity enhancer is conveniently present at a concentration of at most 1000 ppmw, preferably between 50 and 1000 ppmw, more preferably between 100 and 1000 ppmw. Suitable commercially available lubricity enhancers include ester- and acid-based additives. Other lubricity enhancers are described in open literature references, in particular in connection with their use in low sulfur content diesel fuels, for example in:

- the paper by Danping Wei and H. A. Spikes, "*The Lubricity of Diesel Fuels*", Wear, III (1986) 217-235;
- WO-A-95/33805—cold flow improvers to enhance lubricity of low sulfur fuels;
- WO-A-94/17160—certain esters of a carboxylic acid and an alcohol wherein the acid has from 2 to 50 carbon atoms and the alcohol has 1 or more carbon atoms, particularly glycerol monooleate and di-isodecyl adipate, as fuel additives for wear reduction in a diesel engine injection system;
- U.S. Pat. No. 5,490,864—certain dithiophosphoric diester-dialcohols as anti-wear lubricity additives for low sulfur diesel fuels; and
- WO-A-98/01516—certain alkyl aromatic compounds having at least one carboxyl group attached to their aromatic nuclei, to confer anti-wear lubricity effects particularly in low sulfur diesel fuels;

which references are all incorporated herein by reference.

It is also preferred that the additive contain an anti-foaming agent, more preferably in combination with an anti-rust agent and/or a corrosion inhibitor and/or a lubricity additive.

Unless otherwise stated, the (active matter) concentration of each such additional component in the additized fuel composition is preferably up to 10000 ppmw, more preferably in the range from 0.1 to 1000 ppmw, advantageously from 0.1 to 300 ppmw, such as from 0.1 to 150 ppmw, relative to the weight of the diesel fuel.

The (active matter) concentration of any dehazer in the fuel composition may preferably be in the range from 0.1 to 20 ppmw, more preferably from 1 to 15 ppmw, still more preferably from 1 to 10 ppmw, advantageously from 1 to 5 ppmw, relative to the weight of the diesel fuel. The (active matter) concentration of any ignition improver present may preferably be 2600 ppmw or less, more preferably 2000 ppmw or less, conveniently from 300 to 1500 ppmw, relative to the weight of the diesel fuel.

The additive may typically contain a detergent, optionally together with other components as described above, and a diesel fuel-compatible diluent, which may be a carrier oil (e.g. a mineral oil), a polyether, which may be capped or uncapped, a non-polar solvent such as toluene, xylene, white spirits and those sold by Shell companies under the trade mark "SHELLSOL", and/or a polar solvent such as an ester and, in particular, an alcohol, e.g. hexanol, 2-ethylhexanol, decanol, isotridecanol and alcohol mixtures such as those sold by Shell companies under the trade mark "LINEVOL", especially LINEVOL 79 alcohol which is a mixture of $C_{7-9}$ primary alcohols, or a $C_{12-14}$ alcohol mixture which is commercially available.

If desired, the additive components, as listed above, may be co-mixed, preferably together with suitable diluent(s), in an additive concentrate, and the additive concentrate may be dispersed into the fuel, in suitable quantity to result in a composition of the present invention. The blend of components (a) and (b) may be prepared by blending the component (a) with component (b).

As indicated hereinbefore, significant reductions in emissions of oxides of nitrogen are found when, in accordance with this invention, a diesel fuel comprising a blend consisting of the diesel fuel derived from a Fischer-Tropsch process and the mineral oil based diesel fuel having a sulfur content of less than 100 ppmw is combusted in a diesel engine. The reduction is relative to the emission which is found when combusting a diesel fuel comprising the said mineral oil based diesel fuel, without the diesel fuel derived from a Fischer-Tropsch process, and may typically amount to at least 5%, more typically at least 7%, and typically at most 25%, more typically at most 20%.

It has also been indicated hereinbefore that with respect to the emission of oxides of nitrogen the diesel fuel derived from a Fischer-Tropsch process and the mineral oil based diesel fuel having a sulfur content of less than 100 ppmw exhibit a non-linear blending behavior, which unexpectedly provides a larger decrease in the emission of oxides of nitrogen than would be expected on the basis of a linear blending behavior. When combusting in the diesel engine the diesel fuel comprising the blend consisting of the diesel fuel derived from a Fischer-Tropsch process and the mineral oil based diesel fuel having a sulfur content of less than 100 ppmw, the diesel engine unexpectedly produces an emission of oxides of nitrogen which is P % lower than an emission of oxides of nitrogen which can be calculated on the assumption of a linear blending behavior of the two components in the blend, P is relative to the emission of oxides of nitrogen caused by the said mineral oil based diesel fuel, and P is defined by the equation $$P=A\cdot X\cdot(1-X),$$

in which equation A is a number in the range of from 10 to 25, and X is the weight fraction of the diesel fuel derived from a Fischer-Tropsch process in the blend, expressed as a number in the range of from 0 to 1.

The value of A may typically be at least 12, more typically at least 14. The value of A may typically be at most 20, more typically at most 18. The value of A may be for example 16.

An important aspect of the invention is that the advantageous non-linear blending behaviour enables a more efficient use of diesel fuel derived from a Fischer-Tropsch process when combating emissions of oxides of nitrogen caused by diesel engine powered vehicles participating in traffic. Such traffic may be the traffic of a country, or it may be the local traffic in a city or in a smaller community, such as a town or village. The number of vehicles involved may amount to for example at least 50 or at least 100, preferably at least 1000 and more preferably greater than 10,000. The vehicles may or may not be the vehicles of a fleet. The vehicles of a fleet are understood to be those vehicles that are commonly owned or controlled. Preferably, the fleet may comprise at least 50 vehicles, typically at least 100 vehicles, more typically at least 500, and preferably at least 1000 vehicles. Vehicles belonging to the fleet may be, for example, busses, tractor-trailers, or taxis. As indicated hereinbefore, on the basis of a certain quantity of a diesel fuel derived from a Fischer-Tropsch process a larger decrease in the cumulative emissions of oxides of nitrogen can be achieved when diesel engine powered vehicles participating in said traffic are fuelled with diesel fuel comprising a blend in accordance with this invention rather than with a diesel fuel comprising the diesel fuel derived from a Fischer-Tropsch process without the mineral oil based diesel fuel.

The examples below are intended to further illustrate the invention and are not to be construed as limiting the scope thereof.

EXAMPLES

Experiments comprised testing a Fischer-Tropsch derived diesel fuel (Fuel B) alone, a mineral oil based diesel fuel (Fuel A) and blends of Fuel A and Fuel B. The properties and corresponding ASTM method of analysis of the fuels and one of the blends used in these examples are given in Table I.

TABLE I

| Property | Method (ASTM) | Fuel A | Fuel B | Blend of 45% w Fuel A and 55% w Fuel B |
|---|---|---|---|---|
| Density (g/mL) | D4052 | 0.8314 | 0.7865 | 0.8067 |
| Sulfur (ppmw) | D5453 | 1.6 | 0.3 | 1.0 |
| Nitrogen (ppmw) | D4629 | 5.7 | <1.0 | 3.0 |
| $T_{10}$ (° C.) | D0086 | 181 | 246 | 192 |
| $T_{50}$ (° C.) | D0086 | 298 | 298 | 272 |
| $T_{90}$ (° C.) | D0086 | 331 | 331 | 330 |
| Aromatics (% w) | D5186 | 9.2 | 0.5 | 4.5 |
| PNA (% w) | D5186 | 2.5 | 0.1 | 0.8 |
| Cetane Number | D0613 | 42.7 | >76 | 65 |
| Ramsbotton on 10% | D524 | 0.07 | 0.03 | 0.04 |

The testing protocol for the examples was the California Air Resources Board (CARB) Procedure for Certification of Emissions Reductions for Alternative Fuels—Alternative 3. The diesel engine operated was a 1991 Detroit Diesel Corporation (DDC) Series 60 HDD engine, a heavy duty engine, installed in a transient capable test cell. The testing involved seven days of three consecutive hot starts per day with a 20 minute engine-off soak between runs on each fuel. Emissions of the following were measured according to the EPA Federal Test Procedure in the Code of Federal Regulations, Title 40, Part 86, Subpart N (40 CFR §86(N)): hydrocarbons (HC), carbon monoxide (CO), carbon dioxide ($CO_2$), oxides of nitrogen (NOx) and particulate matter (PM). Results are given in Table II.

TABLE II

| Fuel A (% w) | Fuel B (% w) | HC (g/hp-hr) | CO (g/hp-hr) | $CO_2$ (g/hp-hr) | $NO_x$ (g/hp-hr) | PM (g/hp-hr) |
|---|---|---|---|---|---|---|
| 100 | 0 | 0.112 | 2.21 | 552.4 | 4.906 | 0.146 |
| 80 *) | 20 *) | 0.093 | 2.08 | 547.7 | 4.542 | 0.158 |
| 67 *) | 33 *) | 0.082 | 2.00 | 545.5 | 4.421 | 0.154 |
| 45 *) | 55 *) | 0.066 | 1.84 | 545.1 | 4.254 | 0.148 |
| 25 *) | 75 *) | 0.055 | 1.76 | 541.5 | 4.046 | 0.139 |
| 0 | 100 | 0.041 | 1.62 | 532.9 | 4.007 | 0.127 |

*) in accordance with the invention, others for comparison

Table III shows the emissions of oxides of nitrogen relative to the emission of emission of oxides of nitrogen found in the case of Fuel A (i.e. the mineral oil based diesel 5 fuel; Fuel A is taken as 100), and the reduction in the emissions relative to the emission found in the case of Fuel A.

TABLE III

| Fuel A (% w) | Fuel B (% w) | $NO_x$ emissions (Fuel A = 100) | Reduction in $NO_x$ emissions, relative to emission caused by Fuel A (%) | P (%) |
|---|---|---|---|---|
| 100 | 0 | 100 | 0 | 0 |
| 80 *) | 20 *) | 92.6 | 7.42 | 3.74 |
| 67 *) | 33 *) | 90.1 | 9.89 | 3.86 |
| 45 *) | 55 *) | 86.7 | 13.3 | 3.24 |
| 25 *) | 75 *) | 82.5 | 17.5 | 3.78 |
| 0 | 100 | 81.7 | 18.3 | 0 |

*) in accordance with the invention, others for comparison

The FIGURE shows a plot of the emissions of oxides of nitrogen relative to the 10 emission of oxides of nitrogen found in the case of Fuel A (i.e. the mineral oil based diesel fuel; Fuel A is taken as 100) and a curve fitted to these data. The curve follows the equation $$y=0.0015x^2-0.3322x+99.689 \quad (1)$$

wherein y represents the emissions of oxides, taking 100 as the value for Fuel A; and x represents the weight fraction of Fuel B (the Fisher-Tropsch derived diesel fuel) in the blend, expressed in % w. The FIGURE shows also a straight line representing a notional linear blending behavior of the Fuels A and B. This straight line follows the equation $$y=-0.183x+100 \quad (2)$$

wherein y and x are as defined hereinbefore. Because of the non-linear blending behavior, there is unexpectedly and advantageously an extra decrease in the emissions of oxides of nitrogen.

For each of the blends, the value of the extra decrease as a result of non-linear blending behavior has been calculated from the values presented in the right column of Table III and values which can be calculated from equation (2). The calculated values of the extra decrease (P, in %, relative to the emission of oxides of nitrogen found in the case of Fuel A) have been shown in Table III. P appears to follow the equation $$P=0.0016\cdot x\cdot(100-x), \text{ or}$$

$$P=16\cdot X\cdot(1-X),$$

wherein x is as defined hereinbefore, and X represents the weight fraction of Fuel B (the Fisher-Tropsch derived diesel fuel) in the blend, expressed as a number in the range of from 0 to 1 (i.e. $x=100\cdot X$). In this Example, the value of A, defined hereinbefore, was found to equal approximately 16.

We claim:

1. A method of operating a heavy duty diesel engine, that provides relative reduction to the emission of oxides of nitrogen caused by the operation of the heavy duty diesel engine, the method comprising:

(a) providing to the combustion chamber of the heavy duty diesel engine a diesel fuel comprising a blend consisting of (i) a diesel fuel derived from a Fischer-Tropsch process; and (ii) a mineral oil based diesel fuel having an aromatic content of less than 30% w, a sulfur content of less than 100 ppmw, and a $T_{90}$ of more than 261° C., wherein the weight fraction of component (i) in the blend is between 0.28 and 0.5;

(b) combusting said diesel fuel in said heavy duty diesel engine;

(c) producing an emission of oxides of nitrogen from said combustion which is P % lower than an emission of oxides of nitrogen which can be calculated on the basis of a linear blending behavior of components (i) and (ii), P is relative to the emission of oxides of nitrogen caused by the said mineral oil based diesel fuel, and P is defined by the equation $$P=A\cdot X\cdot(1-X),$$

in which equation A is a number in the range of from 10 to 25, and X is the weight fraction of component (i) in the blend, expressed as a number in the range of from 0 to 1.

2. The method of claim 1 wherein the blend further comprises one or more additives selected from the group consisting of detergents, dehazers, anti-foaming agents, anti-rust agents, anti-static agents, pipeline drag reducers, flow improvers, lubricity additives, antioxidants and wax anti-settling agents.

3. The method of claim 1 wherein at least 50 heavy duty diesel engines are operated from steps (a) to (c) in diesel engine powered vehicles participating in traffic.

4. A method of operating a diesel engine, which method comprises:

(a) combusting in the diesel engine a diesel fuel comprising a blend consisting essentially of:

(i) a diesel fuel derived from a Fischer-Tropsch process; and (ii) a mineral oil based diesel fuel having a sulfur content of less than 100 ppmw and an aromatic content of less than 30% w;

wherein the weight fraction of component (i) in the blend is between 0.28 and 0.5; and, (b) producing an emission of oxides of nitrogen which is lower than an emission of oxides of nitrogen which can be calculated on the basis of a linear blending behavior of components (i) and (ii).

5. A method of operating a diesel engine as defined in claim 4 wherein the blend includes one or more additives selected from the group consisting of detergents, dehazers, anti-foaming agents, anti-rust agents, anti-static agents, pipeline drag reducers, flow improvers, lubricity additives, antioxidants and wax anti-settling agents.

6. The method of claim 4 wherein the mineral oil based diesel fuel has a $T_{90}$ of more than 261° C.

7. A method of operating a diesel engine, which method comprises:

(a) combusting in the diesel engine a diesel fuel comprising a blend consisting essentially of (i) a diesel fuel derived from a Fischer-Tropsch process; and (ii) a mineral oil based diesel fuel having a sulfur content of less than 100 ppmw and an aromatic content of less than 30% w, wherein the weight fraction of component (i) in the blend is between 0.28 and 0.5;

(b) producing an emission of oxides of nitrogen which is P % lower than an emission of oxides of nitrogen which can be calculated on the basis of a linear blending behavior of components (a) and (b), P is relative to the emission of oxides of nitrogen caused by the said mineral oil based diesel fuel, and P is defined by the equation $$P=A\cdot X\cdot(1-X),$$

in which equation A is a number in the range of from 10 to 25, and X is the weight fraction of component (i) in the blend, expressed as a number in the range of from 0 to 1.

8. A method of reducing the emission of oxides of nitrogen caused by diesel engine powered vehicles participating in traffic, which method comprises (a) providing a diesel fuel comprising a blend consisting essentially of (i) a diesel fuel derived from a Fischer-Tropsch process; and (ii) a mineral oil based diesel fuel having a sulfur content of less than 100 ppmw and an aromatic content of less than 30% w, wherein the weight fraction of component (i) in the blend is between 0.28 and 0.5, and (b) combusting the diesel fuel in the diesel engines of at least 50 vehicles of the vehicles participating in said traffic;

(c) producing an emission of oxides of nitrogen which is lower than an emission of oxides of nitrogen which can be calculated on the basis of a linear blending behavior of components (i) and (ii).

9. The method of claim 8 wherein the diesel engines are heavy duty diesel engines.

10. The method of claim 1 wherein the mineral oil based diesel fuel in step (a) has at least 2% w aromatic content.

11. The method of claim 4 wherein the mineral oil based diesel fuel in step (a) has at least 2% w aromatic content.

12. The method of claim 7 wherein the mineral oil based diesel fuel in step (a) has at least 2% w aromatic content.

13. The method of claim 8 wherein the mineral oil based diesel fuel in step (a) has at least 2% w aromatic content.

14. The method of claim 1 wherein the blend in step (a) has a value on Ramsbottom on 10% which is lower than the value on Ramsbottom on 10% which can be calculated on the basis of a linear blending behavior of components (i) and (ii).

15. The method of claim 4 wherein the blend in step (a) has a value on Ramsbottom on 10% which is lower than the value on Ramsbottom on 10% which can be calculated on the basis of a linear blending behavior of components (i) and (ii).

16. The method of claim 7 wherein the blend in step (a) has a value on Ramsbottom on 10% which is lower than the value on Ramsbottom on 10% which can be calculated on the basis of a linear blending behavior of components (i) and (ii).

17. The method of claim 8 wherein the blend in step (a) has a value on Ramsbottom on 10% which is lower than the value on Ramsbottom on 10% which can be calculated on the basis of a linear blending behavior of components (i) and (ii).

18. The method of claim 1 wherein in step (a) the blend has:
a boiling range of from 160° C. to 355° C.;
a $T_{90}$ of at least 310° C.;
an aromatic content less than or equal to 30% w;
a cetane number of at least 42;
a sulfur content of less than 50 ppm;
a Ramsbottom on 10% of less than 0.15; and,
a nitrogen content of less than 10 ppm.

19. The method of claim 4 wherein in step (a) the blend has:
a boiling range of from 160° C. to 355° C.;
a $T_{90}$ of at least 310° C.;
an aromatic content less than or equal to 30% w;
a cetane number of at least 42;
a sulfur content of less than 50 ppm;
a Ramsbottom on 10% of less than 0.15; and,
a nitrogen content of less than 10 ppm.

20. The method of claim 7 wherein in step (a) the blend has:
a boiling range of from 160° C. to 355° C.;
a $T_{90}$ of at least 310° C.;
an aromatic content less than or equal to 30% w;
a cetane number of at least 42;
a sulfur content of less than 50 ppm;
a Ramsbottom on 10% of less than 0.15; and,
a nitrogen content of less than 10 ppm.

21. The method of claim 8 wherein in step (a) the blend has:
a boiling range of from 160° C. to 355° C.;
a $T_{90}$ of at least 310° C.;
an aromatic content less than or equal to 30% w;
a cetane number of at least 42;
a sulfur content of less than 50 ppm;
a Ramsbottom on 10% of less than 0.15; and,
a nitrogen content of less than 10 ppm.

22. The method of claim 1 wherein the diesel fuel derived from a Fischer-Tropsch process, component (a), has:
at least 90% w of iso and linear paraffins;
a boiling range of from about 150° C. to 400° C.;
a $T_{90}$ of from 280° C. to 340° C.;
a density of from 0.76 g/mL to 0.79 g/mL at 15° C.;
a cetane number of at least 60; and,
a viscosity of from 2.5 centistokes to 4 centistokes at 40° C.

23. The method of claim 1 wherein in step (a) the weight fraction of component (i) in the blend is at least 0.3.

24. The method of claim 4 wherein in step (a) the weight fraction of component (i) in the blend is at least 0.3.

25. The method of claim 7 wherein in step (a) the weight fraction of component (i) in the blend is at least 0.3.

26. The method of claim 8 wherein in step (a) the weight fraction of component (i) in the blend is at least 0.3.

27. The method of claim 1 wherein in step (a) the weight fraction of component (i) in the blend is at most 0.4.

28. The method of claim 4 wherein in step (a) the weight fraction of component (i) in the blend is at most 0.4.

29. The method of claim 7 wherein in step (a) the weight fraction of component (i) in the blend is at most 0.4.

30. The method of claim 8 wherein in step (a) the weight fraction of component (i) in the blend is at most 0.4.

31. The method of claim 1 wherein the mineral oil based diesel fuel has an aromatic content of at most 20% w.

32. The method of claim 4 wherein the mineral oil based diesel fuel has an aromatic content of at most 20% w.

33. The method of claim 7 wherein the mineral oil based diesel fuel has an aromatic content of at most 20% w.

34. The method of claim 8 wherein the mineral oil based diesel fuel has an aromatic content of at most 20% w.

35. The method of claim 1 wherein the mineral oil based diesel fuel has an aromatic content of at most 10% w.

36. The method of claim 1, wherein in step (a) the blend has a boiling range of from 160° C. to 355° C.; a $T_{90}$ of at least 310° C.; an aromatic content less than or equal to 20% w; a cetane number of at least 42; a sulfur content of less than 50 ppm; a Ramsbottom on 10% of less than 0.15; and a nitrogen content of less than 10 ppm.

37. The method of claim 4, wherein in step (a) the blend has a boiling range of from 160° C. to 355° C.; a $T_{90}$ of at least 310° C.; an aromatic content less than or equal to 20% w; a cetane number of at least 42; a sulfur content of less than 50 ppm; a Ramsbottom on 10% of less than 0.15; and a nitrogen content of less than 10 ppm.

38. The method of claim 7, wherein in step (a) the blend has a boiling range of from 160° C. to 355° C.; a $T_{90}$ of at least 310° C.; an aromatic content less than or equal to 20% w; a cetane number of at least 42; a sulfur content of less than 50 ppm; a Ramsbottom on 10% of less than 0.15; and a nitrogen content of less than 10 ppm.

39. The method of claim 8, wherein in step (a) the blend has a boiling range of from 160° C. to 355° C.; a $T_{90}$ of at least 310° C.; an aromatic content less than or equal to 20% w; a cetane number of at least 42; a sulfur content of less than 50 ppm; a Ramsbottom on 10% of less than 0.15; and a nitrogen content of less than 10 ppm.

* * * * *